US006676320B1

(12) United States Patent
Wainer

(10) Patent No.: US 6,676,320 B1
(45) Date of Patent: Jan. 13, 2004

(54) DEVICE FOR DISPENSING MASCARA

(75) Inventor: Stephanie Kellar Wainer, Brookline, MA (US)

(73) Assignee: Key Beauté INC, Brookline, MA (US)

( * ) Notice: Subject to any disclaimer, the term of this patent is extended or adjusted under 35 U.S.C. 154(b) by 0 days.

(21) Appl. No.: 09/994,125

(22) Filed: Nov. 26, 2001

(51) Int. Cl.[7] ..... A46B 11/00; A46B 17/08

(52) U.S. Cl. ..... 401/122; 401/121; 401/127

(58) Field of Search ..... 401/118, 121, 401/122, 126–130; 220/695, 697, 698; 251/9

(56) References Cited

U.S. PATENT DOCUMENTS

| | | | | | |
|---|---|---|---|---|---|
| 3,897,722 | A | * | 8/1975 | Harris | 248/282.1 |
| 4,194,848 | A | | 3/1980 | Kingsford | |
| 4,241,743 | A | * | 12/1980 | Schnabel et al. | 401/122 |
| 4,332,494 | A | | 6/1982 | Kingsford | |
| 4,609,300 | A | * | 9/1986 | Robert | 132/218 |
| 4,705,053 | A | | 11/1987 | Goncalves | |
| 4,712,936 | A | * | 12/1987 | Kessler | 300/21 |
| 4,921,366 | A | * | 5/1990 | Hurrell | 220/23.87 |
| 4,997,300 | A | * | 3/1991 | Spivey et al. | 401/123 |
| D320,311 | S | * | 10/1991 | Kuhn | D3/200 |
| 5,728,740 | A | * | 3/1998 | Barrett | 424/195.18 |
| 5,951,185 | A | | 9/1999 | Kingsford et al. | |
| 5,964,931 | A | * | 10/1999 | Korper | 106/31.93 |
| 6,168,334 | B1 | | 1/2001 | Fordham | |
| 6,264,390 | B1 | | 7/2001 | Lee et al. | |

FOREIGN PATENT DOCUMENTS

| | | | | |
|---|---|---|---|---|
| FR | 2153160 A | * | 6/1973 | |
| GB | 2155774 A | * | 10/1985 | 401/122 |

* cited by examiner

*Primary Examiner*—Tuan N. Nguyen
(74) *Attorney, Agent, or Firm*—Kriegsman & Kriegsman

(57) ABSTRACT

A device for dispensing mascara includes a container assembly for holding the supply of mascara and an applicator for dispensing an amount of mascara, the applicator being sized and shaped to penetrate into the container assembly. The container assembly includes a tubular container which is shaped to define an interior cavity into which the supply of mascara is stored. A funnel is disposed within an open neck in the container and includes a rigid member and a flexible member which together define an orifice. A button slidably disposed in the container can be manually depressed so as to urge against the flexible member of the funnel. Accordingly, depression of the button regulates the size of the funnel orifice through which the applicator passes and, in turn, the amount of mascara which is retained onto the applicator upon removal from the container assembly.

20 Claims, 6 Drawing Sheets

DEVICE FOR DISPENSING MASCARA

BACKGROUND OF THE INVENTION

The present invention is directed generally to a device for dispensing cosmetics, such as mascara, and more particularly to a device for removing excess cosmetics from an applicator brush upon its withdrawal from a container.

Mascara is a well known cosmetic which is commonly used to accentuate eyelashes.

Conventionally, the device utilized to dispense mascara comprises a tubular container which is shaped to define an interior reservoir, or cavity, into which the supply of mascara is deposited. The container is also typically provided with a neck shaped to define an orifice which is in communication with the interior reservoir, the orifice serving as the exclusive means of accessing the interior reservoir. A detachable cap is removably mounted onto the neck of the container and serves to selectively enclose the orifice. The detachable cap additionally functions as a handle for manipulating an applicator which is formed onto the free end of a wand which, in turn, is integrally formed onto the cap. With the cap properly mounted onto the container, the stem and the applicator penetrate the interior reservoir of the container and, consequently, are immersed in the supply of mascara. When the stem is then withdrawn from the interior reservoir of the container, a quantity of mascara is retained on the applicator which, in turn, can then be applied onto the eyelashes of the consumer.

One problem that has been encountered with the above-described construction is that the amount of mascara deposited on the applicator frequently exceeds that which is desired and must be removed prior to application to avoid an unsightly accumulation of mascara on the user's eyelashes. For this reason, different approaches have been taken to remove excess mascara from the applicator prior to application. One such approach has been to use a facial tissue or the like to wipe excess mascara from the applicator prior to application. As can readily be appreciated, this approach is cumbersome and requires the availability of said facial tissues or the like. Another approach has been to incorporate some type of wiping mechanism into the mascara dispensing device.

One such wiping mechanism comprises an elastic wiper disposed within the neck of the container. The elastic wiper is shaped to define a circular opening, the diameter of the circular opening being smaller than the minimum transverse diameter of the applicator. The function of the elastic wiper is to exert a wiping action onto the applicator as the stem is withdrawn from the container in order to eliminate excess mascara which is retained onto the applicator.

Although well known and widely used in the art, devices for dispensing mascara which comprise an elastic wiper of the aforementioned type often suffer from a notable drawback. Specifically, it has been found that, when using such a device for dispensing mascara, the quantity of mascara retained onto the applicator upon each extraction of the stem from the container remains relatively constant.

As can be appreciated, precluding a consumer from regulating the quantity of mascara which is retained by the applicator upon each extraction of the stem from the container is highly undesirable. This is because, in certain circumstances, a consumer prefers that a limited amount of mascara be retained on the applicator (e.g., when applying mascara onto lower lashes) whereas, in other circumstances, a consumer prefers that a large amount of mascara be retained on the applicator (e.g., when applying mascara onto upper lashes). Additional factors which may be considered by a consumer when determining the optimum amount of mascara to be retained on the applicator upon each extraction of the stem from the container include, inter alia, the nature of the lashes to be made up (i.e., the length of the lashes, the thickness of the lashes and/or the spacing between the lashes) as well as the make up style desired for the lashes (i.e., a thick, dark, clustered look or a thin, light, softened look).

Accordingly, various techniques and structures have been used to allow a consumer to control the amount of mascara which is retained on the applicator of a mascara dispensing device upon removal from its associated container.

In U.S. Pat. No. 4,705,053, which is incorporated herein by reference, there is disclosed a make up unit which comprises a container for mascara, a cap, and a stem carrying a brush which penetrates into the container via a passage axially traversing a wiper element. The wiper element has a wiping zone defining a passage whose cross section is smaller than that of the brush in its state of rest. The wiper element is formed by a lip whose internal edge defines the brush-receiving passage and is joined at its periphery to a ring of a greater thickness, which can sustain, by an axial compression exerted on it, an elastic deformation leading to a variation of the cross-section of the passage. An adjuster ring controls the compression and a reservoir of mascara is accommodated in a barrel. Thus the degree of compression of the wiper element can be adjusted and, as a result, the force of the wiping action will be adjusted.

Mascara dispensing devices of the types described above suffer from notable drawbacks.

As a first drawback, such devices are typically complex in construction and difficult and costly to manufacture, which is highly undesirable.

As a second drawback, such devices typically have a limited range of settings in the amount of mascara which can be retained onto the applicator upon removal from its corresponding container, which is highly undesirable.

As a third drawback, such devices typically apply an equal force against the applicator during removal and re-insertion of the applicator into its corresponding container. As a result, such devices unnecessarily impede the ability of the consumer to reinsert the applicator into the container after each use, which is highly undesirable.

As a fourth drawback, such devices are often ineffective in removing excess mascara from the applicator. As a result, the consumer is still often required, in an additional step, to manually remove excess mascara from the applicator using a tissue or other similar item. As can be appreciated, this additional step renders the entire mascara application process more time consuming and results in a greater waste of mascara, which is highly undesirable.

SUMMARY OF THE INVENTION

It is an object of the present invention to provide a novel device for dispensing mascara.

It is another object of the present invention to provide a novel device for dispensing mascara which includes a container for holding the supply of mascara and an applicator for dispensing an amount of the mascara from the container.

It is yet another object of the present invention to provide a device as described above in which the applicator is sized and shaped to penetrate into the container, the withdrawal of the applicator from the container resulting in an amount of mascara being retained onto the applicator.

It is still another object of the present invention to provide a device as described above in which the user is able to regulate the amount of mascara which is retained onto the applicator upon withdrawal from the container.

It is yet still another object of the present invention to provide a device as described above which has a limited number of parts, is inexpensive to manufacture and is easy to use.

Accordingly, there is provided a device for dispensing a product, said device comprising a container assembly which is adapted to hold said product, said container assembly comprising, a container shaped to define an interior reservoir and a first opening in communication with the interior reservoir, a funnel disposed within the first opening in said container, said funnel being shaped to define an orifice, a button slidably disposed within said container for regulating the size of the orifice defined by said funnel, and an applicator assembly which is adapted to dispense said product, said applicator assembly being sized and shaped to penetrate said container assembly.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate an embodiment of the invention and, together with the description, serve to explain the principles of the invention. In the drawings wherein like reference numerals represent like parts.

DETAILED DESCRIPTION OF A PREFERRED EMBODIMENT

Figure 1:
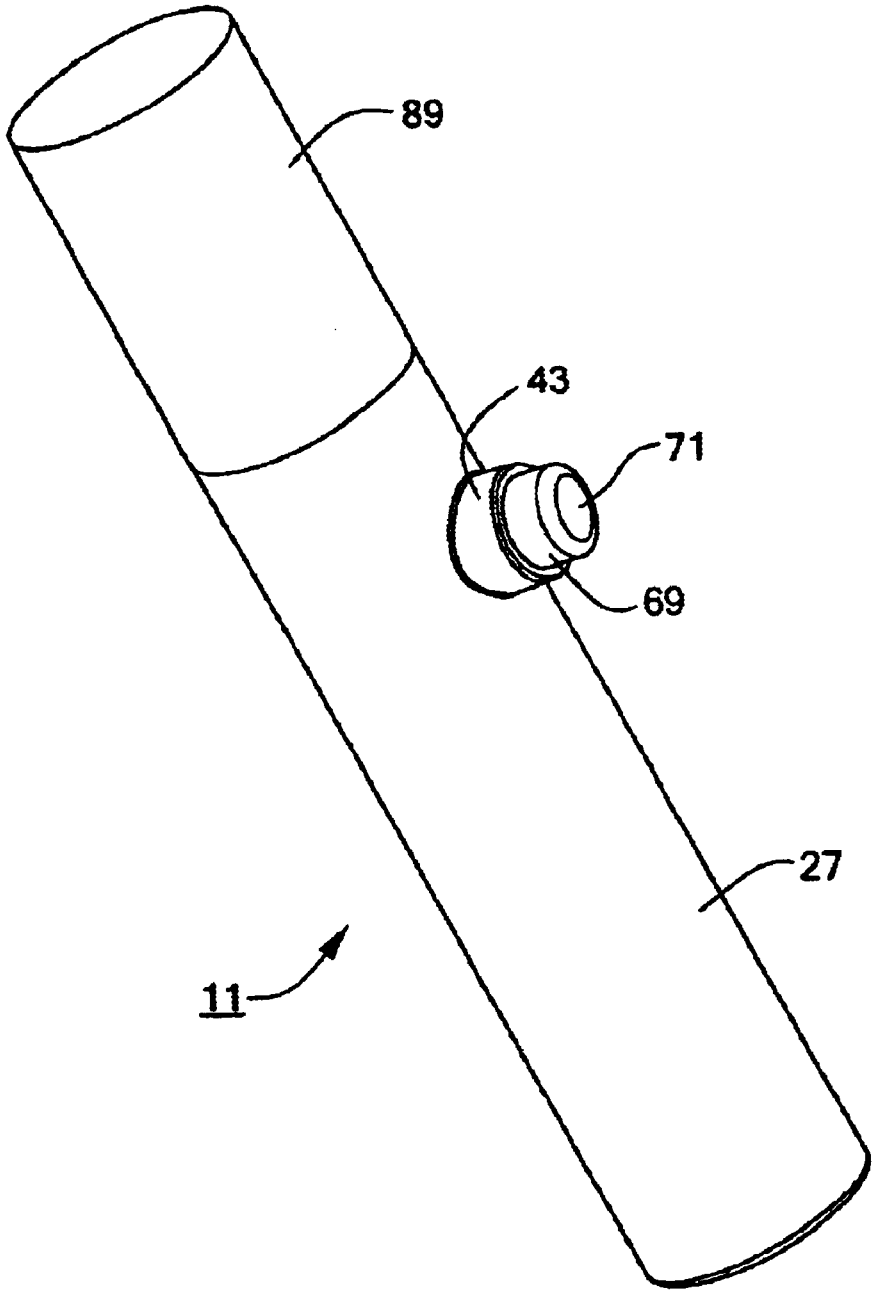
FIG. 1 is a perspective view of a device for dispensing a product, said device being constructed according to the teachings of the present invention.
Figure 2:
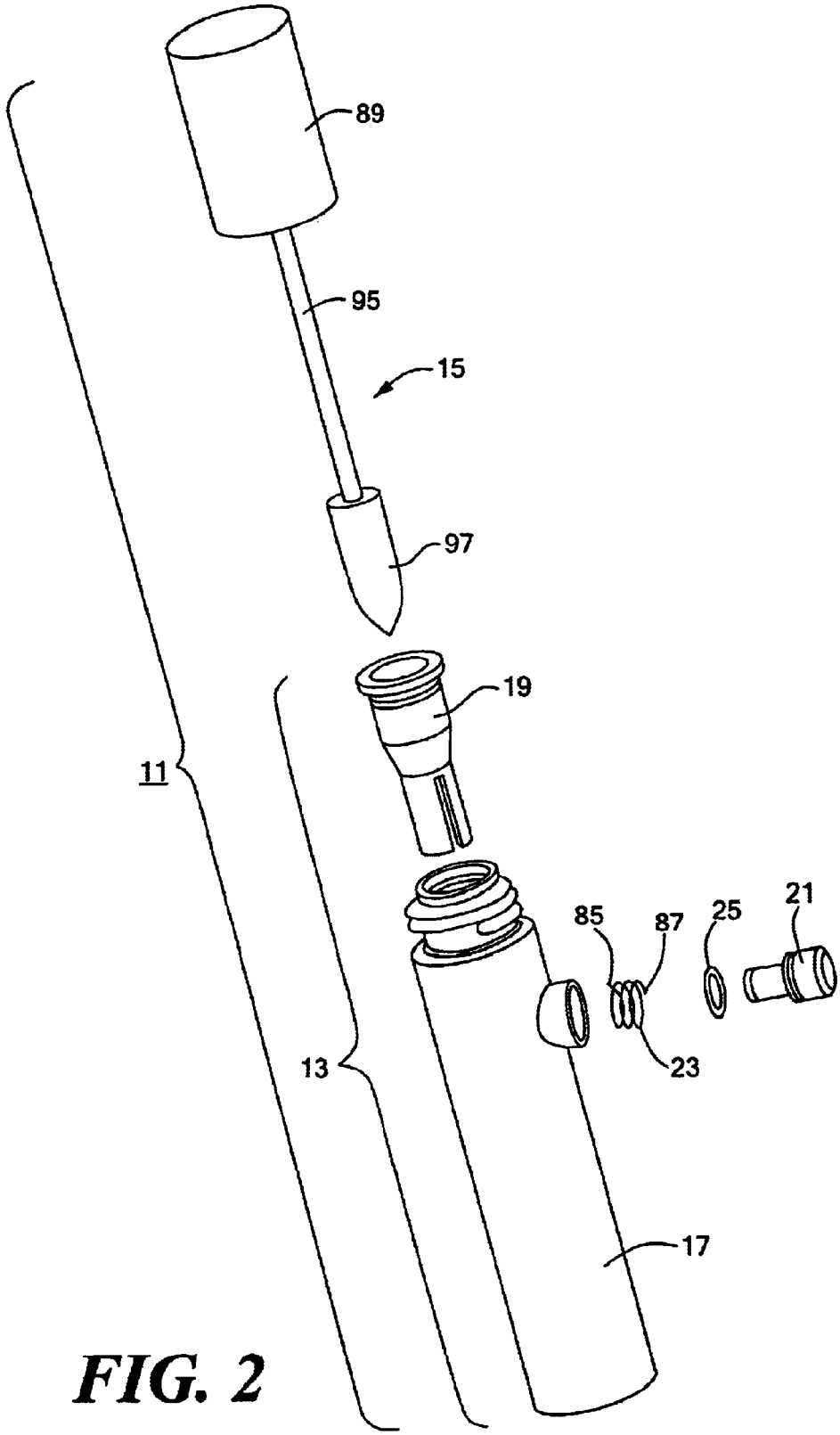
FIG. 2 is an exploded perspective view of the device shown in FIG. 1.

Referring now to FIGS. 1 and 2, there is shown a device for dispensing a product, the device being constructed according to the teachings of the present invention and identified generally by reference numeral 11.

For simplicity purposes only, device 11 is described in detail below as being used to dispense mascara. However, it is to be understood that device 11 is not limited to being used to dispense mascara. Rather, device 11 is designed for use in dispensing any viscous fluid material which is liquid or incorporates a liquid vehicle, as will be described further in detail below.

Device 11 comprises a container assembly 13 for holding a supply of mascara and an applicator assembly 15 for applying an amount of mascara onto eyelashes. Applicator assembly 15 is sized and shaped to penetrate container assembly 13, the withdrawal of applicator assembly 15 from container assembly 13 resulting in an amount of mascara being retained on applicator assembly 15. As will be described further in detail below, container assembly 13 is provided with a manually-actuated mechanism for regulating the amount of mascara which is retained on applicator assembly 15 upon its withdrawal from container assembly 13.

As seen most clearly in FIG. 2, container assembly 13 comprises a container 17 for holding the supply of mascara, a funnel 19 disposed in container 17 for wiping excess mascara from applicator assembly 15 upon its withdrawal from container assembly 13, a button 21 slidably disposed in container 17 in contact with funnel 19 for regulating the amount of excess mascara which funnel 19 wipes from applicator assembly 15 upon its withdrawal from container assembly 13, a spring 23 disposed in container 17 for resiliently urging button 21 away from funnel 19, and an O-ring 25 mounted onto button 21 for providing a tight seal between button 21 and container 17.

Figure 3:
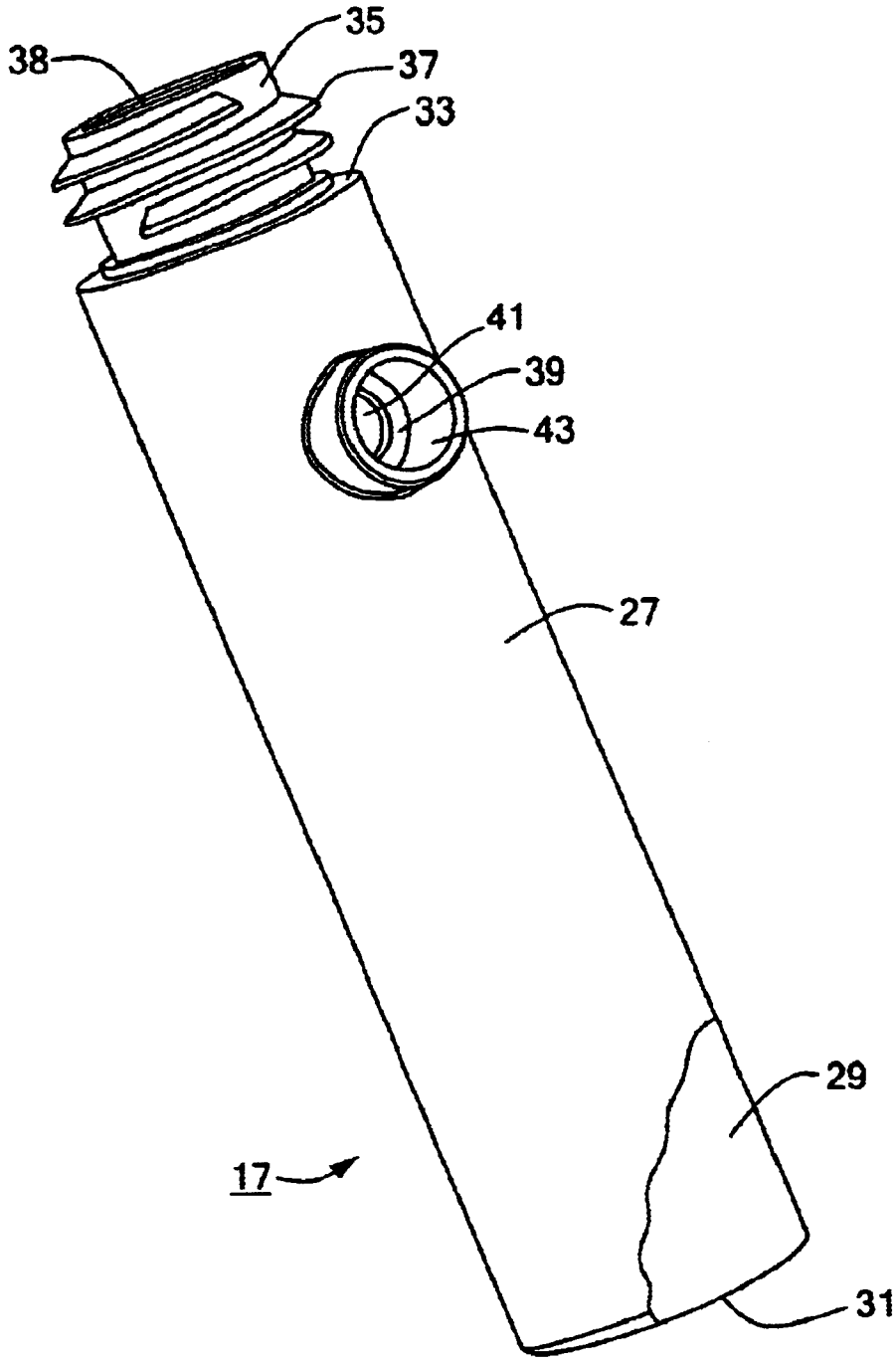
FIG. 3 is an enlarged perspective view, broken away in part, of the container shown in FIG. 1.

As seen most clearly in FIG. 3, container 17 is a unitary device which is preferably constructed of a rigid, durable and inexpensive material, such as plastic. Container 17 comprises a generally tubular portion 27 which is shaped to define an elongated interior reservoir 29 into which the supply of mascara is deposited. Tubular portion 27 includes a closed bottom end 31 and a top end 33.

A cylindrical neck 35 is integrally formed on top end 33 of tubular portion 27, cylindrical neck 35 having a diameter which is slightly less than the diameter of tubular portion 27. Neck 35 extends axially away from top end 33 of tubular portion 27 and comprises a helical threading 37 which is integrally formed onto its outer surface. As will be described further below, neck 35 defines an opening 38 which provides access to the supply of mascara contained within reservoir 29.

An annular flange 39 is formed within tubular portion 27 and defines a circular opening 41 which provides access to interior reservoir 29. A cylindrical boss 43 is integrally formed on tubular portion 27 around the outer periphery of annular flange 39, cylindrical boss 43 extending out from tubular portion 27 at a right angle relative to the longitudinal axis of tubular portion 27.

Figure 4:
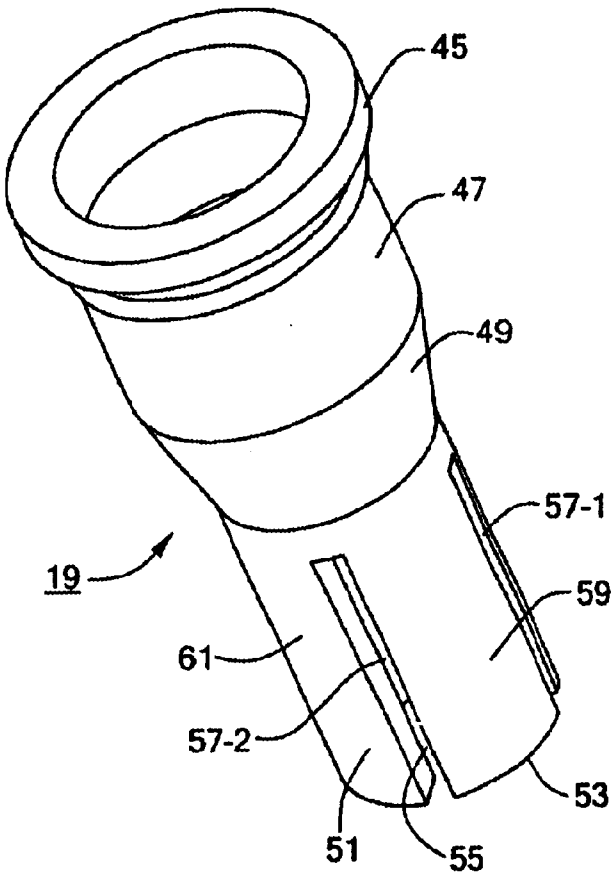
FIG. 4 is an enlarged perspective view of the funnel shown in FIG. 1.

As seen most clearly in FIG. 4, funnel 19 is a unitary device which is preferably constructed of an inexpensive and durable material, such as plastic. Funnel 19 comprises an annular flange 45 which has an outer diameter which is slightly larger than the outer diameter of the free end of neck 35. An upper funnel portion 47 extends axially downward from annular flange 45, upper funnel portion 47 having a generally cylindrical shape which is uniform in lateral cross-section. An intermediate funnel portion 49 extends axially downward from upper funnel portion 47, intermediate funnel portion 49 having an annular shape in lateral cross-section. It should be noted that intermediate funnel portion 49 tapers inward as intermediate funnel portion 49 extends away from upper funnel portion 47, thereby providing intermediate funnel portion 49 with a lateral cross-sectional diameter which gradually decreases as intermediate funnel portion 49 extends away from upper funnel portion 47. A lower funnel portion 51 extends axially downward from intermediate funnel portion 47, lower funnel portion 51 having a generally cylindrical shape which is uniform in lateral cross-section. Lower funnel portion 51 includes a free end 53 which is shaped to define an orifice 55.

A pair of spaced apart slits 57-1 and 57-2 are formed into lower funnel portion 51. Slits 57 extend vertically up from free end 53 and continue substantially the entire length of lower funnel portion 51, slits 57 extending in parallel relation to the longitudinal axis defined by lower funnel portion 51.

Slits 57 are positioned less than 180 degrees apart along lower funnel portion 51. As a result, slits 57 define in lower funnel portion 51 a flexible member, or finger, 59 (e.g., the acute portion of lower funnel portion 51 between slits 57) and a rigid member, or finger, 61 (e.g., the obtuse portion of lower funnel portion 51 between slits 53). As will be described further below, the application of an inward force onto flexible finger 59 causes flexible finger 59 to flex inward which, in turn, reduces the size of orifice 55.

It should be noted that the relative flexibility of finger 59 (as well as the relative rigidity of stationary finger 61) is based upon a plurality of different factors which include, inter alia, the length of slits 57, the degree of spacing between slits 59 and the particular material used to construct funnel 19. As a result, it is to be understood that the relative flexibility of finger 59 could be adjusted by modifying one or more of the factors listed above without departing from the spirit of the present invention.

Funnel 19 is adapted to be pressure-fit within neck 35 of container 17. Specifically, funnel 19 is inserted down into container 17 until the bottom surface of flange 45 rests on top of the free end of neck 35. With funnel 19 disposed within container 17 in this manner, the outer surface of upper portion 47 of funnel 19 is pressure-fit against the inner surface of neck 35, the frictional engagement between upper portion 47 and neck 35 serving to retain funnel 19 within container 17.

It should be noted that funnel 19 is inserted into container 17 in such a manner so that flexible finger 59 of funnel 19 is disposed in direct alignment with circular opening 41 in container 17. As such, longitudinal inward displacement of button 21 within boss 43, in turn, causes button 21 to inwardly flex finger 59, thereby reducing the size of orifice 55, as will be described further in detail below.

Figure 5:
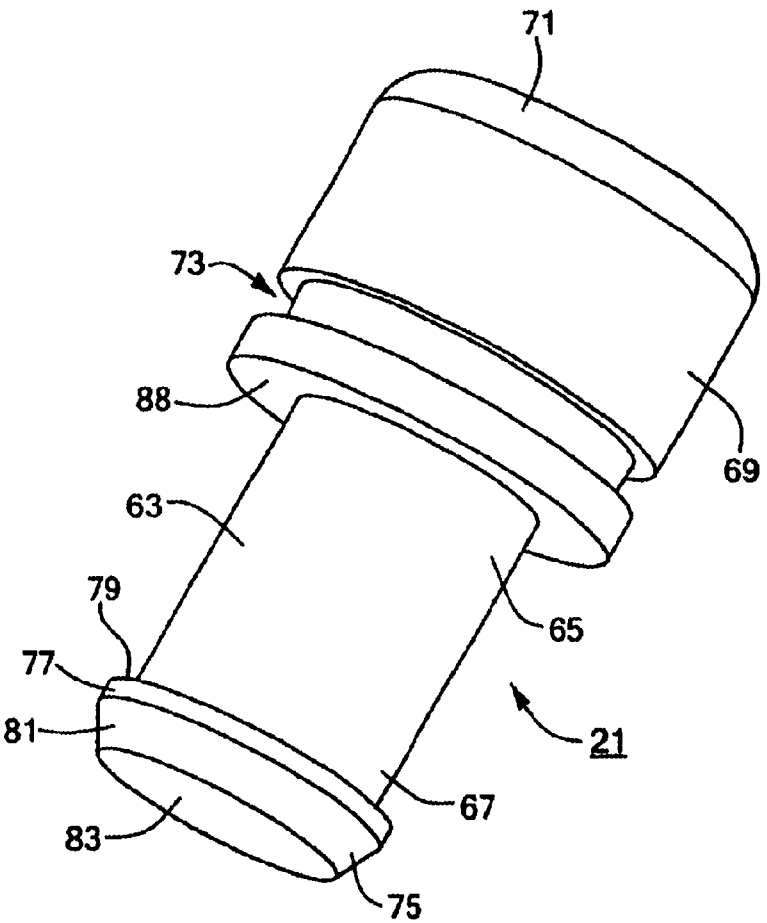
FIG. 5 is an enlarged perspective view of the button shown in FIG. 1.

As seen most clearly in FIG. 5, button 21 is a unitary device which is preferably constructed of a rigid, durable and inexpensive material, such as plastic. Button 21 comprises an elongated shaft 63 which has a uniform circular shape in lateral cross-section, shaft 63 including a first end 65 and a second end 67.

An enlarged knob 69 is formed onto first end 65 of shaft 63, knob 69 and shaft 63 sharing a common longitudinal axis. Knob 69 is generally cylindrical in shape and has a lateral cross-sectional diameter which is greater than the lateral cross-sectional diameter of shaft 63.

Knob 69 is shaped to include a flattened free end 71 which serves as an actuation surface for manually depressing button 21. An annular groove 73 is formed into knob 69, annular groove 73 having a uniform depth. As will be described further below, groove 73 is sized and shaped to receive O-ring 25.

A tapered head 75 is formed onto second end 67 of shaft 63, head 75 and shaft 63 sharing a common longitudinal axis. Head 75 comprises an inner portion 77 which extends axially away from second end 67. Inner portion 77 is generally cylindrical in shape and has a uniform cross-sectional diameter which is greater than the cross-sectional diameter of shaft 63. Inner portion 77 is shaped to include a flattened locking surface 79 which acts as a stop for retaining button 21 in place within boss 43, as will be described further in detail below.

Head 75 further comprises an outer portion 81 which extends axially away from the free end of inner portion 77. Outer portion 81 inwardly tapers away from inner portion 77 and includes a flat funnel abutment surface 83 at its free end.

Button 21 is constructed in such a manner so that head 75 is capable of being inwardly compressed. As will be described further below, the inward compressibility and the tapered configuration of head 75 allows for button 21 to be snap-fit into place within boss 43, which is highly desirable.

Spring 23 is a conventional compression spring which is constructed preferably of metal. Spring 23 includes a first end 85 and a second end 87 and is sized and shaped to be slidably mounted onto shaft 63 of button 21. As will be described further below, spring 23 serves to resiliently urge button 21 in the direction away from flexible finger 59 of funnel 19.

O-ring 25 is a conventional annular ring which is constructed preferably of silicon rubber. O-ring 25 is sized and shaped to fit snugly within annular groove 73 formed in knob 69. The function of O-ring 25 is to provide an adequate seal between button 21 and boss 43, thereby precluding the inadvertent entering or exiting of fluids through opening 41.

Button 21, spring 23 and O-ring 25 are installed in container 17 in the following manner. With button 21 separated from container 17, O-ring 25 is slidably mounted onto knob 69 in such a manner so that O-ring 25 is fittingly disposed within annular groove 73. In addition, spring 23 is slidably mounted onto shaft 63 in such a manner so that second end 87 of spring 23 abuts against inner abutment surface 88 of knob 69.

With spring 23 and O-ring 25 mounted onto button 21 as such, head 75 of button 21 is inserted into boss 43 of container 17. Button 21 is then inwardly displaced along the longitudinal axis of boss 43 until outer portion 81 of head 75 contacts flange 39. Due to the tapered construction of outer portion 81 of head 75, continued inward displacement of button 21 within boss 43 causes head 75 to slightly inwardly compress in such a manner so that head 75 protrudes entirely through opening 41 defined by flange 39. Once head 75 completely penetrates through opening 41 in flange 39, head 75 resiliently expands to its original shape, thereby producing a tactile snap-fit of button 21 into container 17.

It should be noted that, with button 21 snap-fit into container 17 in the manner described above, upon the application of a withdrawal force of button 21 relative to container 17, locking surface 79 of head 75 eventually abuts against the inner surface of flange 39, thereby precluding button 21 from being removed from container 17, which is highly desirable.

It should also be noted that with button 21 snap-fit into container 17 in the manner described above, first end 85 of spring 23 contacts the outer surface of flange 39 and second end 87 of spring 23 contacts abutment surface 88 of knob 89. Accordingly, the application of an inward force onto free end 71 of knob 69 causes spring 23 to inwardly compress. Upon release of said inward force, spring 23 resiliently expands to its original shape, thereby displacing button 21 axially outward until locking surface 79 of head 75 abuts against the inner surface of flange 39.

Figure 6:
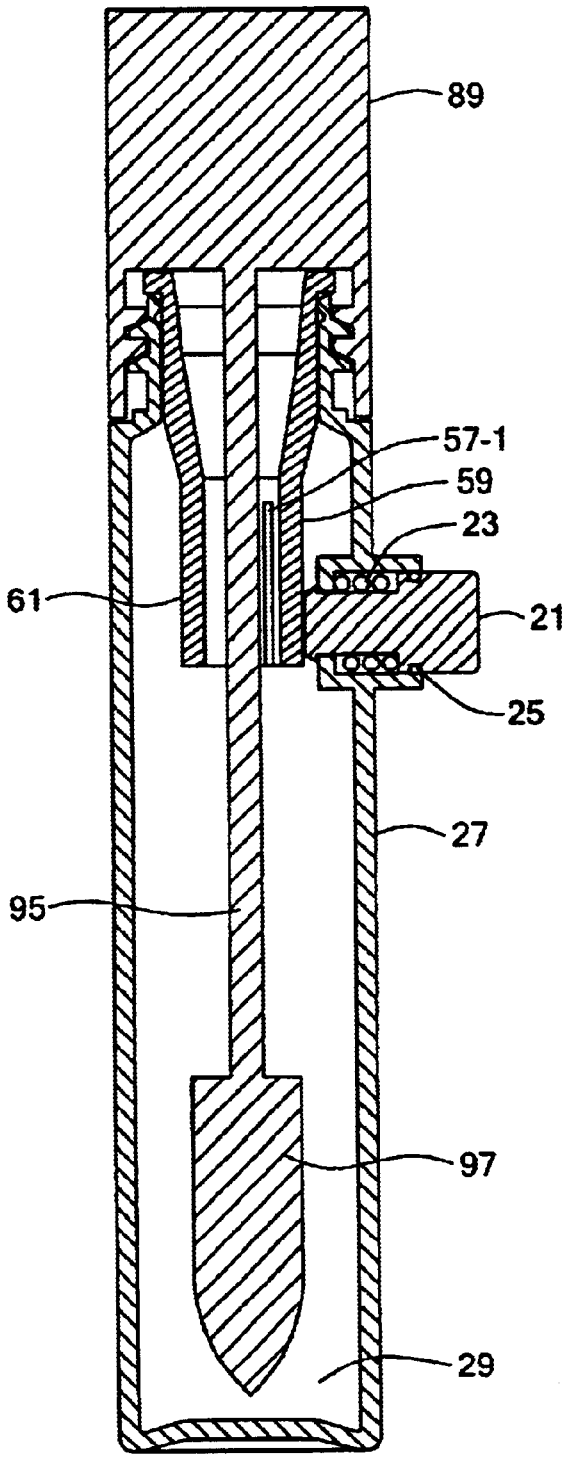
FIG. 6 is a transverse cross-section view of the device shown in FIG. 1, the device being shown with the cap secured onto the container and with the button disposed in a first position.

As can be appreciated, the size of orifice 55 defined by funnel 19 can be regulated through the manual depression of button 21, thereby enabling the user with a tactile means for regulating the amount of mascara which is retained onto applicator assembly 15 upon withdrawal from container assembly 13. Specifically, in the absence of an inward force onto free end 71 of button 21, compression spring 23 outwardly displaces button 21 until locking surface 79 of head 75 against the inner surface of flange 39. With button 21 outwardly displaced in this manner, abutment surface 83 of button 21 contacts flexible finger 59 of funnel 19 but does not apply a force which is large enough to cause flexible finger 59 to inwardly pivot, as seen most clearly in FIG. 6. As a result, lower funnel portion 51 of funnel 19 retains its generally cylindrical shape, thereby providing orifice 55 with its largest possible diameter (which, in turn, maximizes the amount of mascara which is retained onto applicator assembly 15 upon withdrawal from container assembly 13).

Figure 7:
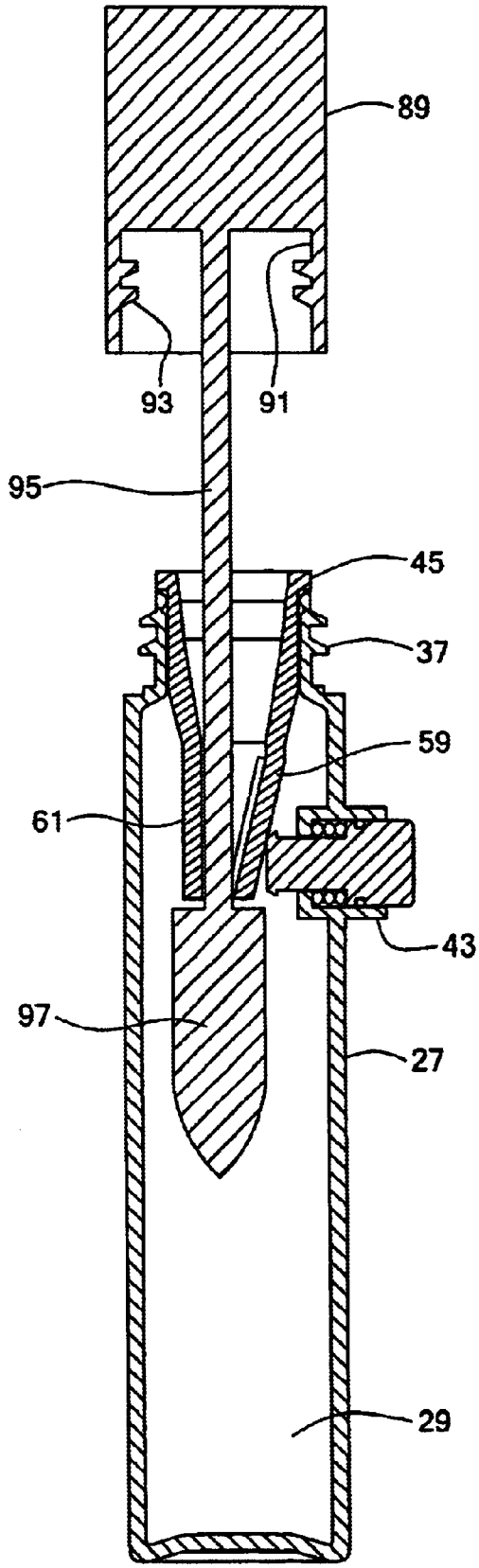
FIG. 7 is a transverse cross-section view of the device shown in FIG. 1, the device being shown with the cap removed from the container and with the button disposed in a second position.

Upon the application of an inward force onto free end 71, button 21 is longitudinally displaced within boss 43 in such a manner that head 75 inwardly pivots flexible finger 59, as seen most clearly in FIG. 7. As a result, the inward flexion of finger 59 reduces the size of orifice 55 (which, in turn reduces the amount of mascara which is retained onto applicator assembly 15 upon withdrawal from container assembly 13).

Applicator assembly 13 comprises a cap 89 which is adapted to be mounted onto neck 35 so as to enclose opening 38. Specifically, cap 89 is in the form of an elongated cylindrical member which is partially hollowed out at one end so as to provide cap 89 with an inner surface 91, as seen most clearly in FIG. 7. It should be noted that inner surface 91 of cap 89 is shaped to include an inwardly protruding, helical threading 93 which is sized and shaped to threadingly engage threading 37 on neck 35 when cap 89 is rotated in the clockwise direction relative to container 17.

An elongated stem, or wand, 95 is formed onto cap 89, wand 95 extending axially away from cap 89. It should be noted that wand 95 has a limited transverse cross-sectional area, thereby enabling wand 95 to easily pass through orifice 55 defined by funnel 19.

An applicator 97 is formed onto and extends axially away from the free end of stem 95. Applicator 97 represents any conventional brush, foam sponge or other similar device which is used to dispense a viscous fluid material. When constructed in the form of a foam sponge, applicator 97 can be used to dispense various types of conventional cosmetics, such as lip gloss, foundation, concealer, eye shadow and eyebrow gel.

It should be noted that the outer diameter of applicator 97 is preferably larger than the maximum diameter of orifice 55. As a result, funnel 19 removes excess mascara which is retained onto applicator 97 each time applicator 97 is withdrawn from interior reservoir 29 of container 17.

It should be noted that the particular construction of applicator assembly 15 does not, by itself, serve as a novel feature of the present invention. Accordingly, it is to be understood that applicator assembly 15 could be replaced with similar types of conventional applicator assemblies without departing from the spirit of the present invention.

In use, device 11 may be used to dispense mascara in the following manner. When not in use or when originally packaged for sale, device 11 is preferably disposed in its closed position, as shown in FIG. 1. With device 11 disposed in its closed position, cap 89 of applicator assembly 15 is threadingly mounted onto neck 35 of container assembly 13 in such a manner so that applicator 97 penetrates down into the supply of mascara which is retained within reservoir 29.

Accordingly, in order to apply mascara onto lashes, cap 89 is rotated in a counterclockwise direction so as to disengage threading 93 on cap 89 from threading 37 on neck 35. With threading 93 disengaged from threading 37, the user grasps cap 89 as a handle and withdraws applicator 97 from reservoir 29.

As applicator 97 is withdrawn from reservoir 29, the user can apply an inward actuation force onto button 21 which, in turn, decreases the size of orifice 55 defined by funnel 19 (wherein the greater the actuation force applied onto button 21, the smaller the resulting size of orifice 55). As applicator 97 passes through orifice 55, funnel 19 removes excess mascara which is retained onto applicator 97 (wherein the smaller the size of orifice 55, the less amount of mascara which is retained onto applicator 97 upon withdrawal). Accordingly, the user is capable of accurately regulating the amount of mascara which is retained onto applicator 97 upon removal from container 17 by varying the actuation force which is applied onto button 21, which is highly desirable.

Device 11 experiences a number of significant advantages over prior art devices for applying mascara. As an example, device 11 comprises a limited number of parts and is relatively simple to assemble, thereby lowering manufacturing costs, which is highly desirable. As another example, device 11 allows the user to regulate the amount of mascara which is retained onto applicator 97 using a variable, manually-applied actuation force, which is highly desirable. As another example, device 11 effectively and efficiently wipes away excess mascara from applicator 97, the excess mascara returning back down into the supply of mascara which remains within reservoir 29, which is highly desirable.

As noted briefly above, device 11 is not limited to the particular application of dispensing mascara. Rather, it is to be understood that device 11 could be used to dispense any viscous material which is liquid or incorporates a liquid vehicle without departing from the spirit of the present invention. Examples of alternative materials which can be dispensed using device 11 include: alternative types of cosmetics (e.g., lip gloss), paper correction fluid (e.g., LIQUID PAPER® paper correction fluid), cement (e.g., rubber cement or contact cement), spot/touch-up automotive paint, barbeque sauce, shoe polish, tree pruning sealer, grease-based compounds which are typically used to prevent metal items (e.g., nuts and bolts) from being frozen, rusted or sealed together, and medical products (e.g., ointments and creams).

The embodiment of the present invention described above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A device for dispensing a product, said device comprising:

(a) a container assembly which is adapted to hold said product, said container assembly comprising, (i) a container shaped to define an interior reservoir, a first opening in communication with the interior reservoir, a second opening in communication with the interior reservoir, and a boss formed around said second opening, (ii) a funnel disposed within the first opening in said container, said funnel being shaped to define a rigid finger and a flexible finger, said rigid finger and said flexible finger together defining an orifice, said flexible finger being capable of inward flexion, (iii) a button, said button being separate from said funnel, said button being slidably disposed within said boss formed in said container and projecting through said second opening for contacting the flexible finger of said funnel so as to regulate the size of the orifice defined by said funnel, wherein said button comprises an elongated shaft, an enlarged knob formed onto one end of said shaft and a tapered head formed onto the other end of said shaft; and (b) an applicator assembly which is adapted to dispense said product, said applicator assembly being sized and shaped to penetrate said container assembly.

2. The device as claimed in claim 1 wherein the tapered head of said button is capable of being inwardly compressed.

3. The device as claimed in claim 2 further comprising a compression spring for urging said button away from said funnel.

4. The device as claimed in claim 3 further comprising an O-ring mounted on said button for providing a seal between said button and said container.

5. The device as claimed in claim 4 wherein said applicator assembly comprises, (a) a cap threadingly mounted onto said container so as to enclose the first opening, (b) a wand coaxial with said cap and having a proximal end integral with said cap, said wand projecting in relation to said cap, and (c) an applicator mounted onto the distal end of said wand, said applicator being adapted to pass through the first opening and immerse in said product when said cap is mounted onto said container.

6. The device as claimed in claim 5 wherein said applicator is sized and shaped to penetrate through the orifice in said funnel.

7. The device as claimed in claim 6 wherein said applicator is in the form of a brush.

8. The device as claimed in claim 6 wherein said applicator is in the form of a foam sponge.

9. The device as claimed in claim 1 in combination with a product disposed within said interior reservoir for being dispensed by said device wherein said product is a cosmetic.

10. The device as claimed in claim 1 in combination with a product disposed within said interior reservoir for being dispensed by said device wherein said product is mascara.

11. The device as claimed in claim 1 in combination with a product disposed within said interior reservoir for being dispensed by said device wherein said product is lip gloss.

12. The device as claimed in claim 1 in combination with a product disposed within said interior reservoir for being dispensed by said device wherein said product is a cosmetic selected from the group consisting of foundation, concealer, eye shadow and eyebrow gel.

13. The device as claimed in claim 1 in combination with a product disposed within said interior reservoir for being dispensed by said device wherein said product is paper correction fluid.

14. The device as claimed in claim 1 in combination with a product disposed within said interior reservoir for being dispensed by said device wherein said product is cement.

15. The device as claimed in claim 1 in combination with a product disposed within said interior reservoir for being dispensed by said device wherein said product is touch-up automotive paint.

16. The device as claimed in claim 1 in combination with a product disposed within said interior reservoir for being dispensed by said device wherein said product is barbeque sauce.

17. The device as claimed in claim 1 in combination with a product disposed within said interior reservoir for being dispensed by said device wherein said product is shoe polish.

18. The device as claimed in claim 1 in combination with a product disposed within said interior reservoir for being dispensed by said device wherein said product is a tree pruning sealer.

19. The device as claimed in claim 1 in combination with a product disposed within said interior reservoir for being dispensed by said device wherein said product is a grease-based compound for preventing metal items from being frozen, rusted or sealed together.

20. The device as claimed in claim 1 in combination with a product disposed within said interior reservoir for being dispensed by said device wherein said product is a medical cream.

* * * * *